United States Patent [19]

Steinel et al.

[11] Patent Number: 4,493,972

[45] Date of Patent: Jan. 15, 1985

[54] ELECTRICALLY HEATED APPARATUS EMPLOYING A PTC HEATER FOR LIQUIFYING A ROD OF BINDING MATERIAL

[76] Inventors: Heinrich W. Steinel, 4, Tannenweg, D-4840 Rheda-Wiedenbrueck; Hans Siwon, 1, Erlenweg, D-8201 Obing, both of Fed. Rep. of Germany

[21] Appl. No.: 333,459

[22] Filed: Dec. 22, 1981

[30] Foreign Application Priority Data

Dec. 29, 1980 [DE] Fed. Rep. of Germany ..... 3049343
Apr. 14, 1981 [DE] Fed. Rep. of Germany ..... 3115047

[51] Int. Cl.[3] ..... H05B 1/02; H05B 3/02; B67D 5/62; H01C 7/02

[52] U.S. Cl. ..... 219/230; 219/241; 219/302; 219/505; 219/530; 219/540; 219/541; 222/146.5; 235/133 R; 235/135; 338/22 R

[58] Field of Search ..... 219/241, 230, 296, 298, 219/299, 301, 302, 305, 504, 505, 530, 540, 241; 222/146 HE, 146 R, 146 H; 338/22 R, 23; 239/135, 133

[56] References Cited

U.S. PATENT DOCUMENTS

| | | | |
|---|---|---|---|
| 3,204,828 | 9/1965 | Paulsen | 222/146 HE |
| 3,338,476 | 8/1967 | Marcoux | 219/505 X |
| 3,612,357 | 10/1971 | Ruskin | 222/146 HE |
| 3,743,142 | 7/1973 | Elliott et al. | 222/146 HE |
| 3,764,045 | 10/1973 | Ornsteen | 222/146 HE |
| 4,104,509 | 8/1978 | Van Bokestal et al. | 219/505 X |
| 4,147,927 | 4/1979 | Pirotte | 219/505 X |
| 4,343,988 | 8/1982 | Roller et al. | 219/302 |
| 4,371,778 | 2/1983 | Meixmer et al. | 219/505 X |

FOREIGN PATENT DOCUMENTS

| | | | |
|---|---|---|---|
| 2804804 | 8/1979 | Fed. Rep. of Germany | 219/302 |

*Primary Examiner*—Anthony Bartis
*Attorney, Agent, or Firm*—Ezra Sutton

[57] ABSTRACT

An apparatus for liquifying a rod of binding by application of heat includes a die-cast aluminum heating member having an elongated conical first channel decreasing in diameter from an inlet adapted to receive a rod of liquifiable bonding material through an elastic funnel surrounding the inlet to an outlet for discharging liquified material through a one-way valve. An electric heater is disposed in a second channel in said member parallel to the first channel and includes an elongated electrically insulating and elastic housing defining a cylindrical cartridge receiving at least one flat PTC resistor disposed between at least a pair of pressure bodies in the housing on opposite sides of the least one PTC resistor. At least one elongated, curved leaf spring is disposed between one of the pressure bodies and at least one PTC resistor for applying pressure to the bodies and the at least one PTC resistor to maintain constant contact pressure therebetween even under thermal expansion and contraction.

14 Claims, 7 Drawing Figures

Fig.1
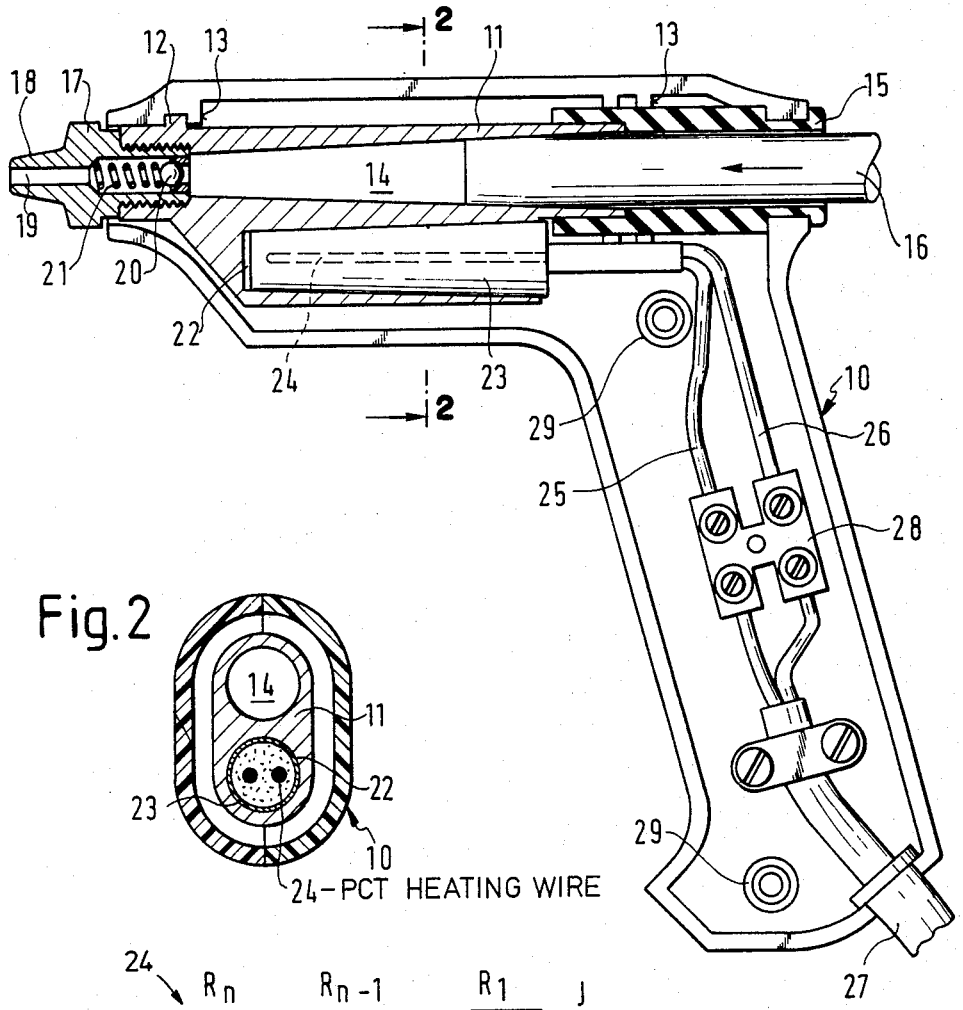
Fig.2
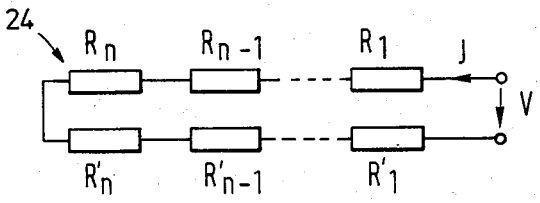
Fig. 3

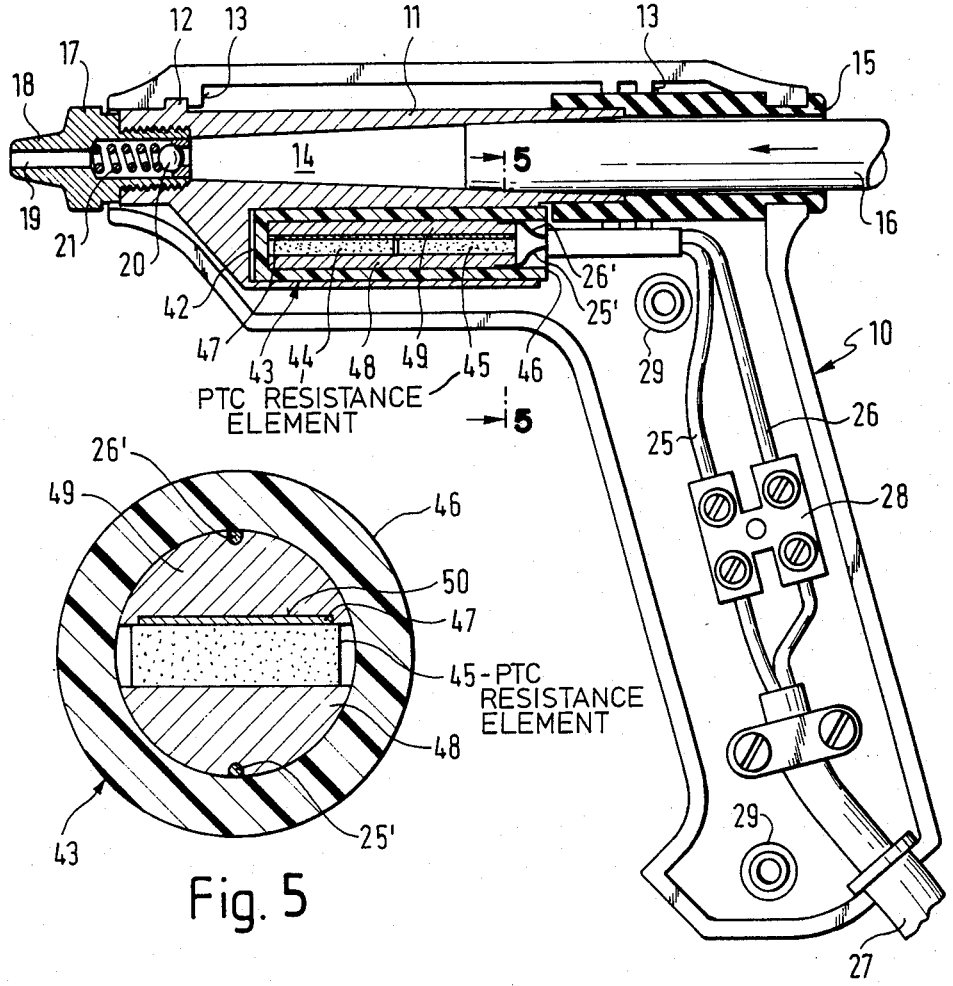
Fig. 4
Fig. 5
Fig. 6
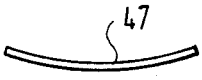
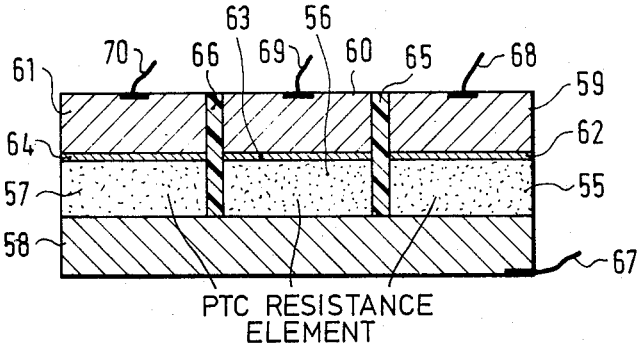
Fig. 7

ELECTRICALLY HEATED APPARATUS EMPLOYING A PTC HEATER FOR LIQUIFYING A ROD OF BINDING MATERIAL

The present invention relates to apparatus for liquefying binding material used to join elements to one another. In particular, it concerns binding material which, in the solid state, is rod shaped and which is melted or liquefied by the application of heat. More specifically, the rod of binding material is inserted into a channel in a heatable member, and an electrical heating apparatus is provided to heat the channel to a temperature at least corresponding to the melting temperature of the binding material. The rod of binding material is melted while in the channel, so that binding material in the liquefied state emerges at the outlet of the channel.

BACKGROUND OF THE INVENTION

Manually operable instruments of the above-described type are well known and allow joining of elements one to another by so-called heat sealing. As mentioned above, the heating sealing or binding material is inserted into a channel as a solid rod, and it is heated by the electrical heating apparatus to a temperature which is at least equal to the melting temperature of the binding material (e.g. 200° C. to 250° C.). The front part of the rod is inserted into the channel first and is liquefied first. As the rod is introduced further into the channel, the liquefied binding material in the outlet end of the channel is ejected and is used to join two elements to one another.

In the known apparatus, the heating is carried out by means of a resistor and an associated thermostat. When a predetermined maximum temperature is exceeded, the heating resistor is disconnected from its source of electrical energy. The resistor effecting the heating can be mounted either outside of the heatable body or in a recess within the body and is so arranged that the heat is distributed evenly along the channel, so that all places along the channel are heated to a predetermined operating temperature. The thermostat which may, for example, be a bimetallic switch, is directly connected to the heating resistor and opens and closes the supply circuit so as to keep the channel's temperature within a predetermined range.

This apparatus requires a relatively long time for preheating, so that the predetermined operating temperature will be reached all along the channel, allowing an inserted rod to be liquefied in the shortest possible time. This preheating requires use of electrical energy prior to actual use of the equipment. Further, it has been shown that insertion of the rod into the heated channel causes a sufficiently large temperature drop that, even with preheating, an additional delay occurs prior to the time the liquefied binding material appears at the outlet of the channel. This also causes an uneven liquefaction of the binding material, that is, the binding material leaving the channel at the start of the operating cycle may be more viscous than the subsequently available material. This causes a variation in the quality of the joints.

SUMMARY OF THE INVENTION

It is an object of the present invention to furnish apparatus which liquefies rod-shaped solid binding material without requiring the lengthy preheating time of the wellknown apparatus. It is a further object of the present invention to furnish apparatus which decreases the variation in viscosity of the liquefied binding material as described above.

In accordance with the present invention, the electrical heating apparatus includes a positive temperature coefficient (PTC) heating resistor. The heating resistor is arranged in an axial direction relative to the channel into which the rod is introduced, so that an axial component of the resistor extends in the axial direction of the channel over a length which is a multiple of the mean diameter of the above-mentioned channel.

The PTC heating resistor, when first connected to the electrical supply, causes a relatively high current to flow. This has the advantage of requiring very little power during preheating and during standby. Additionally, the PTC heating resistor, according to the present invention, is arranged in a particular way, mainly in a direction approximately parallel to the guide channel for the rod of binding material. This means that the PTC heating resistor is not mounted at an arbitrary position on the heatable member, but extends over a relatively long length in the direction of the longitudinal axis of the guide channel for the rod. This is based on the realization that a PTC heating resistor will draw a higher current after reaching a predetermined operating temperature and then being cooled again. This causes the electrical power absorbed to be increased until the temperature has again risen to the predetermined operating temperature. It must be noted that when the rod is first inserted into the channel, the inlet side of the channel is cooled. This cooling is transmitted through the heatable body to that portion of the PTC heating resistor which is closest thereto. The section affected by the decrease in temperature then has a lower resistance value, so that the total current and therefore the total power taken up by the PTC heating resistor is increased. This electrical power is, however, absorbed mainly by that section of the PTC heating resistor which is not directly under the influence of the relatively cool rod. The section of the guide channel in front of the inserted rod is therefore temporarily heated more strongly than usual. The result of this "shifting" of electrical power and thus of the heating zone generated by the PTC resistor into the region in front of the inserted rod is that the front end of the rod liquefies or melts more rapidly, therefore allowing a more rapid insertion of the rod into the channel. At the same time, it is also possible to insert the rod after a much shorter preheating interval, since the "power shifting" along the PTC resistor causes a transient increase in temperature or acceleration of heating of the heatable member in the region preceding the inserted rod in the direction of its advance.

In addition to decreasing energy losses and increasing the uniformity of the viscosity of the binding material, the use of a PTC heating resistor allows the thermostat switch to be dispensed with. This apparatus can operate with different values of supply voltage and the current required in the standby condition is relatively small.

The heating resistor can be arranged in a number of different ways. For example, a PTC resistance wire can be arranged parallel to the guide channel, either in or on the heatable member. The PTC resistance wire preferably extends in the lengthwise direction of the guide channel and may, for example, be U-shaped, so that it affects a larger surface of the heatable member. Instead of a wire, a rod or strip of PTC resistor material may be used. Such resistor elements may be mounted in a recess of the heatable member surrounded by electrically insulating, but highly heat conductive material.

In another type of arrangement, a PTC resistor may be in the form of a coil which surrounds the guide channel. In the simplest case, this may be a PTC resistance wire which is wound around the heatable member. Since the coil extends in the lengthwise direction of the channel, the "power shift" takes place upon insertion of a rod of binding material, as was explained above.

A particularly simple construction, which has proven to be very advantageous, is one in which the heatable member has a second channel parallel to the first or guide channel. A cartridge holding a PTC resistance wire is arranged in this second channel. Assembly of the apparatus then consists only of an insertion of the prefabricated resistance cartridge into the second channel and the mounting of the heatable member with the resistance cartridge in a housing with electrical connections. The above-described effect of transient strong heating of the section of the guide channel in front of the inserted rod can be further improved if the second channel and the resistance cartridge are of conical shape, the diameter decreasing in the direction of advance of the rod. This causes the heat transfer from the PTC heating resistor to the heatable member to be intensified in the front portion of the apparatus, while at the same time, a solid seating of the cartridge is assured in the second channel after the cartridge has been pressed in.

When a PTC resistor is used in an elongated resistance cartridge which is inserted into a special channel of the heatable body, the resistor should have the largest possible contact with the surface and a constant fixed position, even when there are long operations and changes in size occurring due to aging. A further requirement concerns the possibility of switching of parts of the PTC heating resistor in order to adjust to different high operating temperatures.

In order to fulfill this requirement, a simple construction of the heating apparatus is provided which can be installed easily and also insures that when mass produced, there is good contact with the PTC heating resistor, and additionally makes different types of wiring of the PTC heat resistor possible, as discribed above.

A further feature of the invention is that the resistance cartridge has an electrically insulating heatproof preferably elastic housing in which an elongated PTC resistance substance is installed by a press fit for electrical and/or thermal contact between at least two pressure bodies and includes at least one spring arrangement which has a curvature in the unloaded condition.

Due to this construction, it is possible to install the heating apparatus very simply. The housing is inserted into the second channel which is parallel to the guide channel of the heatable body. Then the pressure bodies are pressed together having therebetween the PTC resistance substance and a spring strip. This assembly is pressed into the housing. The spring strip, one or more, causes both a secure press fit within the housing and a constant contact pressure between the PTC resistance substance and the pressure bodies, even at large temperature changes, because the spring strip arrangement compensates for any changes in size of the various elements automatically so that also a constant electrical contact is maintained with little transfer resistance.

If, in the simplest design of this construction principle, a PTC resistance substance lies between the two pressure bodies, and a spring strip is installed between the PTC resistance substance and an adjacent pressure body, the press fit causes the spring strip to assume a flat configuration in the housing so that the PTC resistance substance makes a satisfactory contact electrically and/or thermally through the spring strip. For the housing, if for example, a low grade elastic material is provided which conducts heat very well, the individual elements of the resistance cartridge do not have to have a close tolerance, since a tight press fit is achieved due to the elasticity when pressed into the housing.

Aging of the material of the individual elements of the resistance cartridge does not affect the contact of the PTC resistance substance disadvantageously, when for example, the material of the housing becomes harder and non-elastic. For example, if a small widening of the inner space occurs, it is compensated for by the spring strip which then bends itself slightly. Because of this, the thermal contact of the PTC resistance substance with the surrounding elements is not greatly affected because the spring unloads slightly and sustains the contact pressure between the various elements within the resistance cartridge. These elements include the pressure bodies, the spring strip, and the PTC resistance substance. In this manner, good electrical and thermal contact is maintained between the various elements of the cartridge and the formation of an air gap between the elements of the cartridge is prevented. The PTC resistance substance is apparently sufficient for the heat conduction to the heatable body when the pressure bodies are formed of a material which conducts heat well, such as aluminum. In order to provide this and still maintain elasticity of the housing, the housing is preferably formed of a mixture of one or several metal oxides with a small amount of silicon.

With such an arrangement, several different design forms can be considered for the heat resistance arrangement within the housing. It appears to be especially useful when the inner space of the housing has a circular cross section and the pressure bodies have a semicircular cross section. The circular cross section insures an even compression from all sides of the arrangement consisting of the PTC resistance substance, the pressure bodies and the spring strip, and at the same time, an even distribution of the contact resistance between the PTC resistance substance and its contact elements.

Also of importance is the immovable position of the spring arrangement, for example, between the one side of the PTC resistance substance and the existing pressure bodies. In order to establish this position before the installation and to maintain this position during the installation, the pressure bodies have on the one side of the PTC resistance substance, i.e., the side facing the PTC resistance substance, a shallow indentation with measurements equal to the particular spring arrangement when pressed together. The particular spring strip is placed into this indentation before the installation, and the pressure bodies are then pressed into the housing with the PTC resistance substance between them. Since the particular spring strip lies in the shallow indentation whose measurements correspond to the measurements of the spring strip, the required tolerance exists for the spring strip when the heating cartridge is pressed together.

When the spring arrangement extends over the total length of the pressure bodies and is slightly smaller than the PTC resistance substance, this will allow direct contact with the surface of one pressure body, and the other pressure body is contacted by two longitudinal strips of the PTC resistance which result from the smaller dimension of the spring arrangement compared with the PTC resistance substance. After being pressed into the heating cartridge, the spring strip is pressed into a rectangular, flat shape, so that the PTC-resistance substance is contacted with the surface of the spring strip.

The PTC resistance substance may have other configurations. For example, it can have a square or rectangular or semicircular cross section which is contacted by a matching arrangement of the mating pressure surface of the pressure bodies and a corresponding position of the spring arrangement. The PTC resistance substance has a suitable rectangular cross section whereby the longer side lies between the pressure bodies. In addition, the PTC resistance substance can be divided up into several separate elements along its length. This can be desirable considering the available sizes of the single elements. A separation into single elements is useful when there are several pressure bodies, i.e., spring strips and a row of single resistors connected to each other in parallel which can be switched on in steps, for example. For the pressure bodies, materials other than aluminum can be employed if they have the characteristic of undergoing a rapid decrease of their thermal conductivity at a certain temperature in order to effect the characteristic curve of the PTC element. In this manner, a faster thermal switch off of the PTC element can be effected which means that its high resistance value is achieved within a shorter period.

The spring arrangement may consist of a single or several spring strips which may depend on the number of pressure bodies. The particular spring strip can be curved perpendicular to its length. It is also possible to bend the particular spring strip one time or several times in the unloaded condition along its length so that a wave-like spring is provided. The design form depends on the particular construction of the PTC resistance substance and the pressure bodies.

The present invention will now be described in detail with reference to the drawings.

BRIEF DESCRIPTION OF THE DRAWINGS

FIG. 1 is a cross sectional view of a pistol type hand apparatus according to a first embodiment of the invention;

FIG. 2 is a vertical cross section along line 2—2 of FIG. 1;

FIG. 3 shows an equivalent circuit of a PTC heating resistor; for explanation according to FIG. 1.

FIG. 4 is a cross sectional view of a pistol type hand apparatus according to a second embodiment of the invention;

FIG. 5 is a vertical cross section along line 5—5 of FIG. 4;

FIG. 6 shows, an end view of the spring strip in the unloaded condition for the resistance cartridge according to FIG. 5;

and

FIG. 7 shows a longitudinal section of an additional principal arrangement within a resistance cartridge.

DESCRIPTION OF THE PREFERRED EMBODIMENTS

FIG. 1 shows a pistol-shaped hand-operated instrument also know as a heat sealing pistol. It includes a heat-insulated plastic housing 10 which contains a heatable member 11. The latter can be a die-cast aluminum part. It has projections 12 with which it is retained in housing 10 by corresponding die-cast ribs 13. Ribs 13 can also be used for anchoring other elements.

Heatable member 11 has an elongated die-cast channel 14. The end of channel 14, shown on the right-hand side of FIG. 1, is extended by a bushing 15 made of a plastic material, for example silicone. Bushing 15 is slipped onto the end of the heatable body 11, which is shown on the right-hand side of FIG. 1, and extends to the exterior area of housing 10. It allows easy and smooth insertion of the rod 16 made of the binding material and further prevents unnecessary heat loss towards the outside through the right-hand end of heatable member 11.

As shown in FIG. 1, guide channel 14 is a conical channel whose diameter decreases from the right-hand to the left-hand side. On the left, it terminates in a valve unit 17, which has a mouthpiece 18, the latter constituting the actual outlet 19 for the liquefied binding material. Valve unit 17 includes a one-way valve in the form of a ball valve 20 which operates under the control of a spring 21. Specifically, the valve opens when a predetermined pressure is exerted from the material in guide channel 14.

Valve unit 17 may also be a die-cast aluminum member. It may also be manufactured of other material, for example, brass.

A second longitudinal channel 22 is provided in heatable member 11. Channel 22 extends in a direction substantially parallel to guide channel 14 and is situated below the latter. It is also of conical shape, and its diameter decreases, as does that of guide channel 14, from the right-hand to the left-hand end. Channel 22 extends along most of the length of guide channel 14. Specifically, in the illustrated example, it extends over more than three-fifths of the length of the latter. A PTC (positive temperature coefficient) resistor cartridge 23 is arranged in the second channel 22. It may be pressed into channel 22 or may be glued or screwed into that channel. The PTC resistance cartridge 23 includes a PTC resistance wire 24 which, in the illustrated example, is U-shaped in the horizontal plane. It is supplied with electrical energy by two conductors 25 and 26. For this purpose, a connecting cable 27 is connected to lines 25 and 26 at a terminal 28.

A solid resistor may be provided instead of the PTC resistance wire 24 within a cartridge 23. For example, a PTC resistance rod having a length corresponding to the length of resistance wire 24 may be provided. It is also possible, although not illustrated in the drawing, that a PTC resistance coil may be wound around the heatable member in such a way that this coil extends over the greater part of the length of the guide channel.

In section 2—2 of FIG. 1, as shown in FIG. 2, it will be noted that housing 10 consists of two half shells, which may be glued, welded, or screwed (29, FIG. 1) together. As mentioned before, guide channel 14 is situated above second channel 22, the latter containing the PTC resistance cartridge 23. It will be noted that PTC resistance wire 24 is embedded in cartridge 23 and, because of its U-shape, forms two branches. The material into which resistance wire 24 is embedded should be electrically insulating, but heat conductive. For example, aluminum oxide, a ceramic, or a silicone, or a mixture of these substances could be used.

The cross-sectional view of FIG. 2 illustrates that there is very little heat conductive mass of heating body 11 separating guide channel 14 and second channel 22, since member 11 is relatively narrow. Its width is only slightly larger than the diameter of the two channels 14 and 22.

FIG. 3 is a schematic diagram of an equivalent circuit representing the PTC resistor. Resistance elements $R_1$, $R'_1$ to $R_N$, $R'_N$ are shown. These are connected in series and the so-formed series circuit is connected to a voltage supply V. A current J determined by the resistance values of the individual resistors results in the transformation of electrical power to heat.

The circuit of FIG. 3 should be interpreted in such a way that the two resistors $R_1$, $R'_1$ are located at the rightmost end of cartridge 23 in FIG. 1, while resistors $R_N$, $R'_N$ are in the furthest leftmost position.

If now the rod of binding or sealing material 16 (FIG. 1) is inserted into bushing 15 in the direction of the arrow, and thereafter enters guide channel 14, then its front end first reaches the region including that portion of resistance cartridge 23 in which resistors $R_1$, $R'_1$ are positioned. The relatively cool rod 16 causes a drop in temperature in guide channel 14. This is first transmitted to that section of cartridge 23 in which resistors $R_1$, $R'_1$ are arranged. The resistance values of these resistors therefore decrease substantially, causing an increase of the current J which flows through the whole chain. The resulting increase in electrical power must be absorbed in the main by the remaining resistance elements, that is, in the example shown in FIG. 3, by resistors $R_{N-1}$, $R'_{N-1}$ and $R_N$, $R'_N$. However, these resistors are positioned in a section of cartridge 23 which precedes rod 16 as it enters into the channel. Thus, at least during the time in which the right-hand section of cartridge 23 undergoes a cooling, a more intensive heating takes place in the rest of the PTC resistance wire, since higher electrical power must be dissipated. This in turn causes a relatively strong transient overheating to take place in guide channel 14 in the region preceding rod 16. Rod 16 thus is melted or liquefied more rapidly, and an excessive cooling in the guide channel is prevented, and the viscosity of the binding or sealing material which leaves outlet 19 is uniform. Further, the above-described overheating of channel 14 in the section preceding rod 16 as it is inserted, allows the equipment to be operated properly without a preheating to the prescribed operating temperature. This decreases both the required standby power and the waiting time.

The liquefied binding or sealing material is ejected through outlet 19 by the pressure exerted by rod 16 during its insertion in the guide channel into the already liquefied material. As soon as this pressure exceeds the force exerted by spring 21, valve 20 opens. This action is facilitated by the fact that the diameter of guide channel 14 has, at the left-hand side, decreased to approximately the diameter of valve 20.

In FIGS. 4 to 7, an additional embodiment of the invention is shown. In these figures, the same designation numbers are used for these parts which correspond to the same parts in FIGS. 1 to 3.

Referring to FIG. 4, a second longitudinal channel 42 is provided in the heatable body 11 under the guide channel 14 which lies approximately parallel to the guide channel 14. Channel 42 extends over the largest portion of the length of the guide channel 14, and in this particular embodiment, it extends over more than three-fifths of the length of the guide channel 14. A PTC resistance cartridge 43 is placed into second channel 42, and it may be pressed or screwed into channel 42. The PTC resistance cartridge 43 contains a PTC resistance substance which consists of two single elements 44 and 45, and is supplied electrical energy through two connecting leads 25 and 26. For that purpose, a connecting cable 27 is connected by a connecting terminal 28 to the two connecting leads 25 and 26.

The housing 46 of the PTC resistance cartridge 43 is slightly elastic and electrically non-conductive, but conducts heat well and equalizes any dimensional tolerances of the channel 42 and of the elements to be pressed into it. The housing 46 is closed on the left end in FIG. 4, and on the right end it is open. An assembly is pressed into housing 46 which consists of the two PTC resistance elements 44 and 45, a spring leaf 47, and two pressure bodies 48 and 49. The PTC resistance elements 44 and 45 consist of a generally known ceramic material. They are placed between the pressure bodies 48 and 49 consisting of, for example, aluminum and are supplied with an electrical current which is fed through the connection leads 25 and 26. The ends 25' and 26' of these connection leads 25 and 26 are connected to the two pressure bodies 48 and 49. The electrical and thermal contacts between the PTC resistance elements 44 and 45 and the pressure bodies 48 and 49 are not reduced by the spring leaf 47 because the latter is pressed down due to the press fit arrangement in the housing 46, and therefore maintains a surface contact with the PTC resistance elements 44 and 45.

FIG. 5 shows a cross section of the resistance cartridge 43. The pressure bodies 48 and 49 have a semicircular cross section and, together with the particular PTC resistance elements 44 and 45, form a nearly circular cross section which deviates only by the amount which is dependent on the size of the particular PTC resistance elements 44 or 45. The upper pressure body 49 has on its under side a shallow indentation 50 in which the spring leaf 47 is inserted. The indentation 50 is slightly smaller than the width of the rectangular form PTC resistance elements 44 and 45 so that pressure body 49 stays in contact with the two longitudinal strips on the upper side of the resistance elements.

FIG. 6 shows an end view of the spring leaf 47 viewed from the right in FIG. 4 and in the unloaded condition. The spring leaf 47 has a curvature in this condition perpendicular to its longitudinal distance so that it touches the PTC resistance elements 44 and 45 only tangentially when put together and before press fitting the resistor arrangement into the housing 46. After being pressed into the housing 46, it takes the flat form shown in FIGS. 4 and 5 so that it ensures an even pressure between the PTC resistance elements 44 and 45 and the pressure bodies 48 and 49.

In FIG. 5, it is further shown that the ends 25' and 26' of the connection leads 25 and 26 lie in indentations on the under or upper side of the pressure bodies 48 or 49. They can be pressed in or welded so that an electrical connection is made with the metal pressure bodies 48 and 49.

It should also be understood that changes in the constructive arrangement of the resistance cartridge 43 are possible. For example, a spring leaf can be provided which does not have a transverse bend, but is bent in the direction of its length. For that purpose, the shallow indentation 50 shown in FIG. 5 can be slightly smaller, so that the PTC resistance elements 44 and 45 are in contact with a larger area of the pressure body 49. The smaller design of the indentation 50 is therefore possible because in such construction, pressing of the different parts into the housing 46 does not result in a widening of the spring leaf, but an elongation of it. Furthermore, a spring leaf can be provided which does not have a simple curvature, but for example, a wave-like curvature. Such a curvature is suitable when it is provided along the length of the spring leaf.

By separation of the PTC resistance into several individual elements, as shown in the arrangement according to FIG. 4, it can be useful to provide a separate spring leaf for each element. It can also be considered when a separate electrical switching of such individual resistors is undertaken through separate pressure bodies. A suitable arrangement of separate resistors and pressure bodies and also spring strips is shown in FIG. 7 in a longitudinal section.

Three PTC resistance substances 55, 56, and 57 are between a pressure body 58, and three additional pressure bodies 59, 60, and 61 where in between are three spring strips 62, 63, and 64. The PTC resistance substance 55, 56, and 57 and the pressure bodies 59, 60, and 61 are insulated from each other by electrically non-conducting layers or coatings 65 and 66. The bottom pressure body 58 is connected to an electrical connecting lead 67, and the upper pressure bodies 59, 60, and 61 are connected respectively to electrical connection leads 68, 69, and 70.

Between the lower pressure body 58 and the upper pressure bodies, several of the PTC resistance substances 55, 56, and 57 can be energized so that, for example, a step-by-step energizing and an increase in the heating are possible.

For the arrangement shown in FIG. 7, when the lower pressure body 58 is made of an electrically insulating, good heat conducting material, instead of using partial resistors 55, 56, and 57, only a single continuous PTC resistance substance is provided. With a suitable proportioning of the first and the last pressure bodies, wiring can be provided whereby the current flows in the longitudinal direction through the PTC resistance substance. However, this must have a heat conductive coating which is electrically insulating on one side which the spring contacts.

Although the present invention has been described with reference to preferred embodiments, many variations and changes will occur to one skilled in the art and are intended to be encompassed in the accompanying claims.

What is claimed is:

1. Apparatus for liquifying a rod of binding material by application of heat, comprising:

a heating member having a first channel and a second channel; said first channel extending in a predetermined direction from an inlet adapted to receive a rod of liquifiable binding material to an outlet for discharging liquified material from the rod, said second channel extending in said predetermined direction;

electrical heating means disposed within said second channel for creating in said first channel a temperature at least equal to the temperature required to liquify the rod, said electrical heating means comprising an elongated cartridge enclosing a positive temperature coefficient resistance means extending in said predetermined direction;

said positive temperature coefficient resistance means includes at least one PTC resistor;

said cartridge includes an electrically insulated and elastic housing for receiving said at least one PTC resistor;

at least two pressure bodies disposed within said housing on opposite sides of said at least one PTC resistor;

spring means disposed between one of said pressure bodies and said at least one PTC resistor for applying pressure to said at least one PTC resistor and to said at least two pressure bodies; and said heatable member being of a size relative to each of said first and second channels to minimize the mass and heat sink characteristics of said heatable member.

2. Apparatus as set forth in claim 1, wherein said positive temperature coefficient resistance means extends in said predetermined direction for a distance equal to at least three-fifths of the length of said first channel.

3. Apparatus as set forth in claim 1, wherein said heatable member is a die-cast aluminum member and wherein said first channel is conical in shape having a decreasing diameter in said predetermined direction.

4. Apparatus as set forth in claim 3, further comprising an elastic funnel surrounding said inlet of said first channel.

5. Apparatus as set forth in claim 1, further comprising a one-way valve at said outlet of said first channel, said valve being adapted to open in response to pressure on liquefied rod material contained in said first channel during insertion of said rod.

6. Apparatus as set forth in claim 1, wherein one of said pressure bodies has on one of the sides facing said at least one PTC resistor a shallow indentation for receiving said spring means.

7. Apparatus as set forth in claim 1, wherein said at least one PTC resistor has flat sides and has a rectangular cross section and wherein the flat sides are in contact with said pressure bodies.

8. Apparatus as set forth in claim 1, wherein said at least one PTC resistor includes a plurality of individual resistor elements.

9. Apparatus as set forth in claim 8, wherein each individual element of said PTC resistor includes a separate spring means.

10. Apparatus as set forth in claim 8, wherein each individual element of said PTC resistor includes a separate pressure body.

11. Apparatus as set forth in claim 8, wherein said elements of the PTC resistor are insulated from each other electrically.

12. Apparatus as set forth in claim 1, wherein said spring means is an elongated leaf spring having a longitudinal axis and is curved perpendicular to said longitudinal axis in its unloaded condition.

13. Apparatus as set forth in claim 1, wherein said spring means is curved about its transverse axis in its unloaded condition.

14. Apparatus as set forth in claim 1, wherein said housing has a circular cross section, said pressure bodies have a substantially semicircular cross section.

* * * * *